United States Patent [19]

Chow

[11] Patent Number: 5,012,705

[45] Date of Patent: May 7, 1991

[54] RATCHET WRENCH WITH MANUALLY REMOVABLE CORE

[75] Inventor: Kirk K. Chow, Dallas, Tex.

[73] Assignee: National Hand Tool Corporation, Dallas, Tex.

[21] Appl. No.: 494,610

[22] Filed: Mar. 16, 1990

[51] Int. Cl.[5] ..... B25B 13/46

[52] U.S. Cl. ..... 81/63; 81/62; 81/61; 81/60

[58] Field of Search ..... 81/63, 63.2, 63.1, 62, 81/61, 60

[56] References Cited

U.S. PATENT DOCUMENTS

| | | | |
|---|---|---|---|
| 4,524,653 | 6/1985 | Konecny | 81/63 |
| 4,528,873 | 7/1985 | Lee | 81/63 |
| 4,762,033 | 8/1988 | Chow | 81/63.2 |

*Primary Examiner*—Frederick R. Schmidt
*Assistant Examiner*—Lawrence Cruz
*Attorney, Agent, or Firm*—Michael G. Berkman

[57] ABSTRACT

A ratchet wrench is described which includes a cap-surmounted core having a rotatable body sleeved in a drive ring. A shiftable pawl intercouples the drive ring and the core for driving the core selectively in each of opposed annular driving modes. A shaft projecting axially from the core terminates in a stud for carrying a tool element. The wrench is characterized in that there is provided a washer-like locking plate having a central opening and positionable axially over the shaft of the core to overlie the body of the core. The plate is configured at its central opening for lockingly keying with the shaft releasably to couple the locking plate with the shaft and to secure the core in the drive ring.

6 Claims, 2 Drawing Sheets

RATCHET WRENCH WITH MANUALLY REMOVABLE CORE

FIELD OF AND BACKGROUND OF THE INVENTION

The present invention relates to a ratchet drive wrench. More particularly, the invention is directed to a ratchet drive wrench having a handle-carried drive head in which a rotatable core is releasably secured.. The core includes an end shank or boss to which a selectable tool element such a socket may be releasably secured. The body of the core houses a shiftable pawl which couples the drive head to the core for rotation of the core, selectively, in each of opposed driving modes.

Ratchet wrenches of the general type to which the present disclosure is directed are known in the prior art. One such wrench is described in K. K. Chow U.S. Pat. application Ser. No. 07/017731, filed Feb. 24, 1987. The entire disclosure of that application is hereby incorporated herein by reference, to the extent it is not inconsistent herewith.

It has been established that in the usual or expected use of ratchet drive wrenches that foreign matter invades the interior of the wrenches and lodges in the zones of manipulative operation of the drive-mode-reversing pawl. The debris not only interferes with the effective operation of the drive wrench, but also contributes materially to deterioration of the working elements and to a shortening of the useful wrench life. It has been found that immersing or washing the tool head and core assembly in a cleansing fluid such as petroleum spirits may clean the wrench superficially but does not effectively remove the entrapped foreign material. Significant "solids" are retained in the tool assembly.

Notwithstanding such periodic "washing", the interior of the wrench retains abrasive solids. These act to accelerate deterioration of the wrench components including the toothed pawl and the cooperating pawl-engaging teeth of the drive ring.

Periodic partial disassembly of ratchet drive wrenches, to an extent of withdrawing and separating the core from the drive ring, followed by a rinsing of these elements in a liquid cleansing composition has been found to be a much more effective maintenance technique for insuring long-life and for retaining good operating capability for the ratchet drive wrenches. For the most part, however, ratchet wrenches can be disassembled only with the use of a tool and with some difficulty in a procedure which may be hazardous to the safety of the wrench user. For example, it is often necessary to employ a prying tool to extracate the locking snap ring or spring band from a groove or channel in which the spring is seated. In other common arrangements one or more locking screws or bolts must be removed before disassembly is possible.

Some ratchet wrenches embody structures which do permit a useful partial disassembly, without the use of tools. Several such wrenches are described in the above referred to K. K. Chow U.S. patent application Ser. No. 07/017731.

The wrench structures there shown allow removal of the core from the drive ring manually, without the use of tools. To this extent the structures obviate certain objectionable features of a majority of prior art devices. Each does, however, require the physical displacement of an internal locking ring, and, or interlocking keying element. Each utilizes outwardly projecting pin or button or shaft.

While the referred to prior art structures are suitable for their intended purpose, to some extent at least, each wrench is subject to or susceptible of a possible inadvertent or unintended actuation of the core releasing mechanism. It is an aim of the present invention to provide in a tool of the general class described exceedingly simple yet highly stable, effective and reliable core-release mechanism which functions without the use of tools, which cannot be activated by accident, which effects a release of the drive-ring-held core, but only under positive and intentional manipulative action, and which oviates other shortcomings of prior art ratchet drive tools.

SUMMARY OF THE INVENTION

The ratchet drive wrench of the present invention includes a drive head and a cap-surmounted core having a core body sleeved within and rotatable within the drive head. A toothed pawl housed within the core body is shiftable between two positions in which separate toothed portions of the pawl engagingly mesh with cooperating internal teeth of the drive ring at annularly spaced sectors on an inner face of the drive ring to provide selective opposed driving directions of the wrench. A shaft which projects axially from the core terminates in a drive stud to which a tool element such as a drive socket may be detachably secured. At its base adjacent the core body the shaft is formed with a flange extending radially from the shaft and spaced from the face of the core to define a groove-like channel. A washer-like locking plate formed with a non-circular opening is positionable over the shaft and over the flange carried thereby and in abutment with to overlie the core body and the drive head. Upon partial rotation of the locking plate, laterally extending wing elements carried thereby enter the channel to seat therewithin and thus to prevent withdrawal of the core body axially from the encircling drive head. Spring-loaded detents couple with and retain the locking plate in a core-locking mode. To release the core, application of digitally applied force to the locking plate rotates the plate through an annular sector to clear the wing elements from the channel in the shaft, and establishes a core-freeing mode. The shaft-encircling locking plate may then be separated from the core shaft to permit withdrawal of the core from the drive ring.

Other features and advantages of the invention will become evident from a reading of the specifications considered in conjunction with the drawings.

DETAILED DESCRIPTION OF ILLUSTRATED EMBODIMENT

The aims and objects of the present invention are realized by providing in a ratchet drive wrench of the type having a tool-carrying drive core secured in and coupled to a drive head, a simple and improved, yet highly effective, hand-manipulable locking mechanism for releasably securing the core of the wrench within the encircling, handle-carried drive head or drive ring. The present invention enables one easily to disassemble the wrench head to the extent of separating the core from the drive ring. In accordance with the present invention the disassembly is carried out quickly and without the use of tools, and facilitates effective cleaning of the internally toothed drive ring and of the toothed, shiftable pawl, and other core body components. Good, reliable operation of the ratchet wrench is thus insured and the useful life of the wrench is extended.

Reassembly of the wrench, after cleaning, requires only that the user relocate the core body within the drive head and affix the locking plate in a locking mode.

Figure 1:
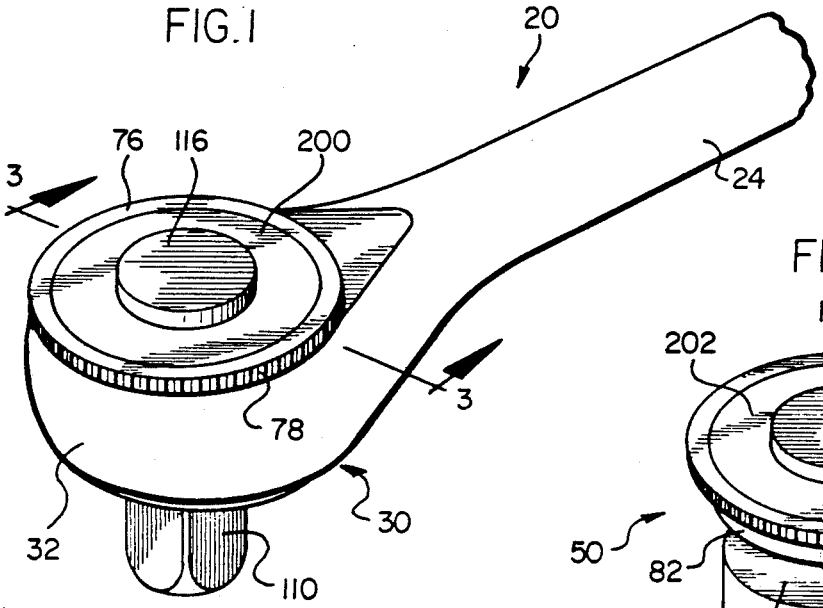
FIG. 1 is a perspective view of the ratchet drive head and of the core and drive shaft of a wrench embodying the features of the present invention, with a portion of the handle broken way.
Figure 2:
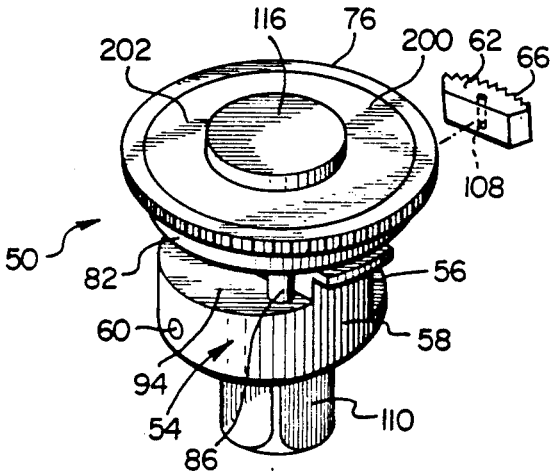
FIG. 2 is a perspective exploded view showing the core body, the drive head and the core-locking plate of a drive wrench, according to the invention.
Figure 3:
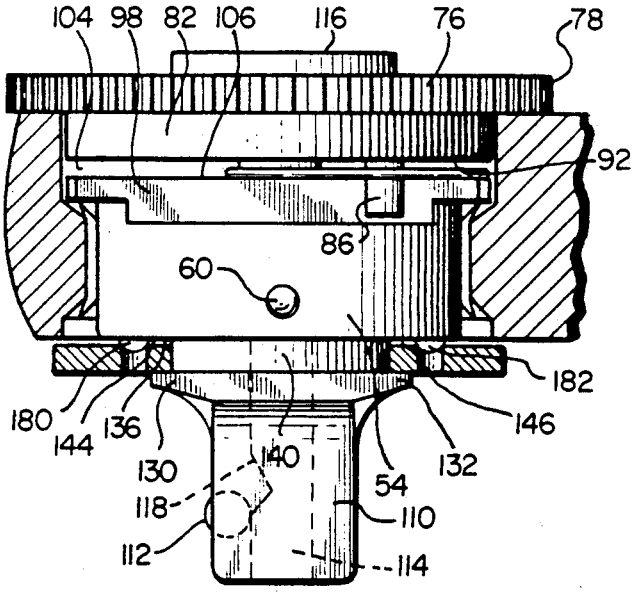
FIG. 3 is a cross-sectional view through the head of the wrench, taken substantially on the lines 3—3 of FIG. 1 and showing an assembled wrench head, including a locking plate restraining the core within the drive head.
Figure 3:
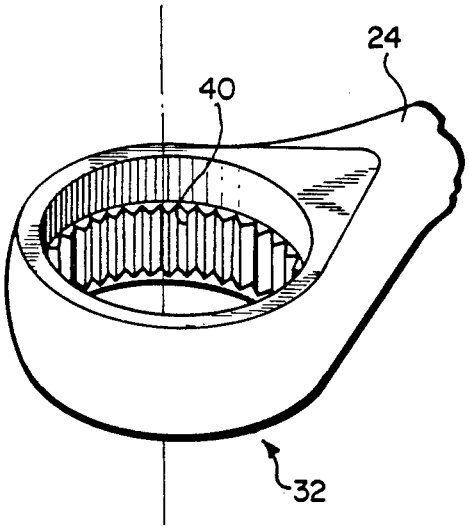
Figure 3:
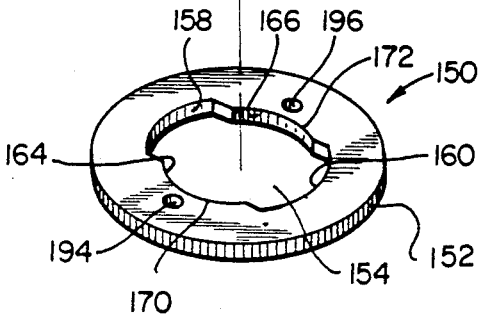

Referring now to the drawings and more particularly to FIGS. 1 through 3, there is shown one preferred embodiment of the invention provided for illustrative purposes only and not to be construed in any limiting sense. The wrench 20 illustrated has a handle 24 to an end of which is connected a tool head or driving head 30 comprising a generally cylindrical driving ring or collar 32 having a cylindrical interior surface 36 with an uninterrupted series of axially extending ratchet teeth 40 (FIG. 2) evenly and circumferentially spaced about an inner wall surface 36 of the drive ring 32 and projecting inwardly thereof.

A driven body or core 50 rotatably journalled in the collar 32 and constituting the torque-transmitting element of the tool head 30 has a generally cylindrical body 54 formed with a transverse recess or cavity 56 extending radially inwardly of and from an encircling bounding cylindrical surface 58 of the core 50. Captive in the core body 54 and extending radially from the surface 58 is a spring-loaded bearing 60 which rides upon the ratchet teeth 40 to offer "resistance" to completely "free" rotation of the core 50 within the drive collar 32.

Housed in the recess 56 is a shiftably postionable, toothed pawl 62 having an array of ratchet teeth 66 on an outer surface thereof opposed to for mating with cooperating complementary facing ratchet teeth 40 of the drive ring 32. An opposite surface 68 of the pawl 62 is faceted to define camming or sliding surfaces for riding reciprocally along a juxtaposed guide wall 72 bounding the cavity 56.

At its upper end the core 50 is formed with an enlarged-diameter cap-like flange 76, a bounding peripheral edge of which is knurled 78 to facilitate manual rotation thereof and of a collar 82 attached thereto.

As shown in FIGS. 2 and 3, a post or pin 86 secured in the collar 82 and projecting downwardly from an underface 92 thereof extends into a cut-away zone 94 formed in the body 54 of the core 50 and opening radially outwardly thereof. The transversely cut-away sector 94 is bounded by a generally planar, transverse wall 98 which serves as a mechanical stop for the pin 86, and thus limits the extent of rotation or arcuate displacement of the collar 82.

A spring wire 102 having a generally planar, heart-shaped body portion is housed in a horizontally disposed spacing 104 between an underside 92 of the collar 82 and a top surface 106 of the core body 54. The spring 102 is shaped to provide an apex which abuts and bears upon the pin 86 on an outside surface thereof, and ends of the spring wire 102 are bent normally of and upwardly of a plane defined by the spring body to seat in a vertical slot or bore 108 formed in the body of the pawl 62 and opening at an undersurface thereof. In the arrangement shown and described, arcuate rotation of the flange 76 and the attached collar 82 effects an arcuate shift of the pin 86. The latter forcibly moves the spring wire 102 at its apex, and the force is simultaneously transmitted to the ends of the spring wire 102 seated in the pawl 62 causing a positive and definitive sliding lateral shift of the pawl 62 along the core guide wall 72, in a toggle-like action Rotation of the flange 76 in the opposite annular direction causes a reversal of the pawl 62 to its opposite travel limit, effecting a reversal of the driving mode of the core 50 and a boss or shank 110 extending therefrom.

The shank or boss 110 is of a non-circular transverse cross section and is integrally formed with and extends axially from a lower face of the core body 54 for attachment of selectable, interchangeable tool elements thereto.

As shown in FIG. 3, a detent ball or bearing 112 which is captively retained within the boss 110 is urged radially outwardly to a socket or tool-engaging or locking disposition by means of a longitudinally extending rod or shaft 114. The latter extends upwardly through the tool head and is coupled mechanically to a vertically-depressible button 116, the shaft 114 and the button 116 being biased to an upwardly displaced position by means of an internal spring (not shown). Applying downward pressure on the button 116 effects a downward displacement of the shaft 114 to bring a declevity or cut-away portion 118 of the shaft 114 opposite or in lateral correspondence with the detent ball 112 permitting the ball 112 to move radially inwardly so as to release a tool element such as a socket carried on the boss 110.

It is an important feature of the ratchet drive of the invention that there is provided a structure in which the core 50 may be easily removed from the drive ring 32 for cleaning and for preventive maintenance care. The disassembly and reassembly are, in accordance with the present invention, conveniently carried out without the need for tools, and using a simple yet highly effective combination of a mechanical lock plate keyed on and retained on a flanged shaft.

Figure 4:
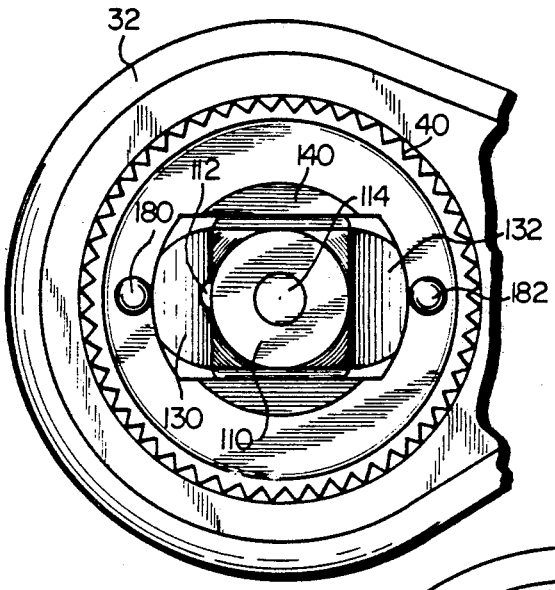
FIG. 4 is a fragmentary, bottom view showing the core within the drive head, and the locking plate removed.

Referring now to FIGS. 3 and 4, the tool-carrying boss 110 is flared outwardly at an upper end zone thereof to form a pair of opposed, laterally-extending flanges 130 and 132 spaced axially from an undersurface 136 of the core body 54 by a connecting, integrally formed, stub neck 140. The neck 140 is round in transverse section and has a diameter less than an overall diametric expanse of the laterally projecting flanges 130 and 132 so that there is provided a pair of diametrically spaced keyways, slots, or channels 144 and 146 between the undersurface 136 of the core body 154 and the axially-spaced, opposed top surfaces of the flanges 130 and 132.

As shown in a functional position in FIG. 3, but as best seen in FIG. 2, there is provided a washer-like locking plate 150 having a knurled, circumscribing outer edge 152 and a non-circular central opening 154. In the particular embodiment of the plate 150 shown, the central opening 154 is delineated along a first diametric expanse by a pair of diametrically-opposed, arcuate sectors 158 and 160 of a circle having a diameter slightly greater than that of a distance measured between opposed, inwardly-facing outer edges of the flanges 130 and 132 so that the plate 150 is slideably positionable, axially, over the flanges 130 and 132. In a second diametric direction, normal to and in the same plane as in the first diametric expanse, the opening 154 is bounded by arcuate sectors 164 and 166 having a diameter slightly greater than the neck 140 inscribed within the channels 144 and 146 so that the lesser-sized "circular" opening in the locking plate 150 is slideably positionable, contiguously, to encircle the neck 140, as shown in FIG. 3. In the functional use of the locking plate 150, those wall portions bounding the lesser diametric expanse, at the sectors 164 and 166 serve as radially inwardly directed wings 170 and 172 or keying projections for slideably and matingly engaging within the channels 144 and 146 for locking the plate 150 in a fixed position on the neck 140 below and integrally formed with the core body 54.

Figure 5:
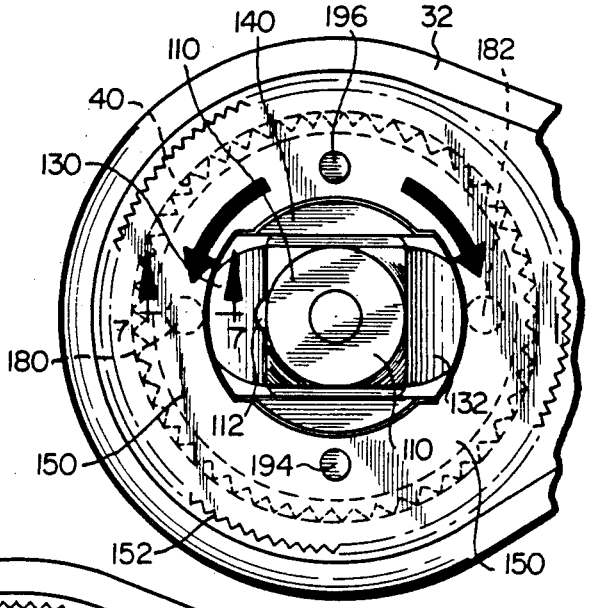
FIG. 5 is a view similar to that in FIG. 4, but with the rotatable locking plate in a disengaged mode, prior to assuming a locked-on configuration.
Figure 6:
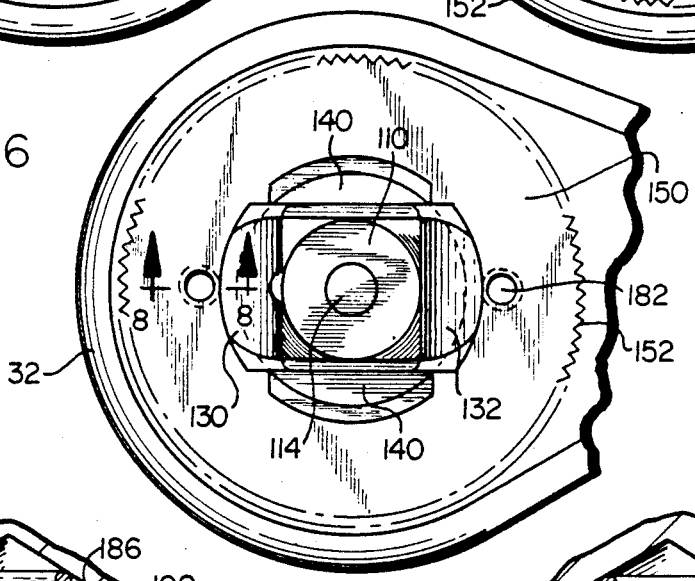
FIG. 6 is a view similar to that in FIG. 5, but with the locking plate rotated one-fourth turn and secured in place, in a core-locking mode.
Figure 7:
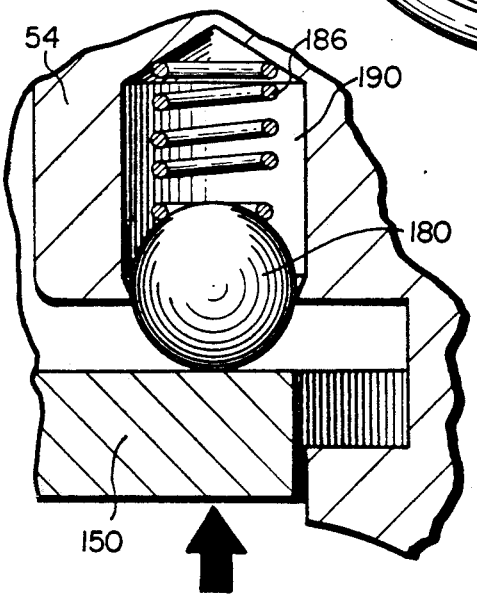
FIG. 7 is enlarged, fragmentary, cross-sectional view taken substantially on the lines 7—7 of FIG. 5 and showing a spring-loaded locking plate detent, according to the invention, in a plate-disengaged mode.
Figure 8:
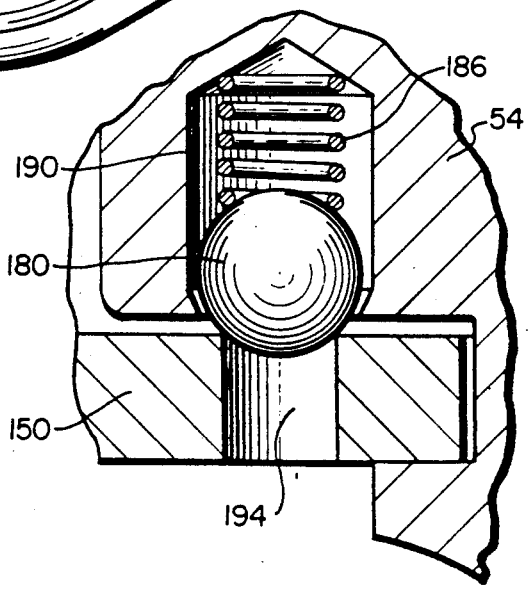
FIG. 8 is an enlarged, fragmentary cross-sectional view taken substantially on the lines 8—8 of FIG. 6 and showing the drive wrench in a use position with a detent, according to the invention, coupled with and securing the locking plate in a fixed, core-locking mode.

As further shown in FIGS. 3 and 4, the core body 54 carries at its undersurface 136, to project therebelow, a pair of diametrically positioned detents, locking beads, or lugs 180 and 182 displaced radially outwardly of the flanges 130 and 132. The beads 180 and 182 are captively retained in the core body 50, but are resiliently biased outwardly of the lower face 136 of the core body 54 by coil springs 186 confined within drilled bores 190. The locking plate 150 is formed with a pair of depressions, bores or through openings diametrically spaced for coincidence or registry with the beads 180 and 182, and sized to accept the beads 180 and 182 therewithin. As shown in FIGS. 3, 6 and 8, when the plate 150 is positioned over the boss 114 and the flanges 130 and 132, and then rotated through 90 degrees (see FIG. 5), to assume a locking orientation, with the keying wings 170 and 172 within the channels 144 and 146, the beads 180 and 182 of the core body 54 penetrate and seat within the bores 194 and 196 in the locking plate 150.

Removal of the locking plate 150 to effectuate disassembly of the tool head 30 by withdrawal of the core 50 from the drive ring 32 is achieved by the simple procedure of manually rotating the locking plate 150, while overcoming the frictional resistance imposed by the spring-loaded detents 180 and 182, through a 90 degree sector to withdraw the flanges 130 and 132 from the confining channels 144 and 146, to free the locking plate 150 from the core 50. The core 50 may then be easily pressed from the driving ring 32 through force directed axially against the boss 110. The core 50 and the drive ring 32 may then be cleaned. Reassembly is by reversing the steps described.

In the illustrated embodiment of the ratchet drive wrench of the invention, the cap-like flange 76 is formed at it upper face with a moat-like depression or channel for accommodating a ring-like insert 200 for displaying source-identifying indicia, a product trademark, or decorative matter 202.

While a preferred embodiment of the invention has been illustrated and described, other variations may be made utilizing the inventive concepts herein disclosed. It is intended that all such variations be considered as within the scope of the invention as defined in the following claims.

What is claimed is:

1. In a ratchet wrench including a drive head, a core having a body surmounted by a radilally-enlarged cap, said core body being rotatable in and releasably secured in said drive head, a shank fastened to and projecting from said core body axially thereof for releasably securing a tool to said shank, pawl means intercoupling said drive head with said core body for reversibly driving said core body and said shank attached thereto in each of selective, opposed annular driving modes upon rotation of said drive head, interlock means for securing said core in said drive head;

said interlock means comprising flange means carried by and extending radially outwardly of said shank and spaced axially from said core body, said flange means and said core body defining an annular channel therebetween, and arcuately shiftable locking plate means having a diametric boundary exceeding a diameter of said core, said locking plate means having a central, key-way-like opening of a non-circular configuration for receiving said flange means of said interlock means therethrough upon positioning of said plate means over said shank in a encircling mode about said shank with said locking plate means overlying said drive head, wing means integrally formed with and generally coplanar with said plate means, said wing means constituting a radially inwardly directed keying projection of said plate means extending into said central opening thereof for slidably and matingly invading said channel to seat therewithin upon arcuate rotation of said plate means through an annular sector and about said shank to establish an orientation of said wing means in at least partial vertical alignment with said flange means and preventing withdrawal of said core axially from said drive head, said plate means being rotatably shiftable to withdraw said wing means from said channel and to permit removal of said plate means from said shank and to allow axial displacement of said core with respect to said locking plate means.

2. The structure as set forth in claim 1 and further comprising spring means interposed between said core and said locking plate means and establishing stressing forces therebetween for opposing relative annular movement of said core with respect to said locking plate means.

3. The structure as set forth in claim 1 wherein said locking plate means is formed with a surface depression on a face thereof presented to and overlying said core body, and further comprising probe means carried by said core body and projecting therefrom at a face thereof presented to said locking plate means, spring means resiliently biasing said probe means to project from said core body, said probe means being alignable for in-line registry with said surface depression in said plate means to seat in said depression and resiliently to stress said locking plate to resist annular displacement when said locking plate assumes a locking mode.

4. The structure as set forth in claim 3 wherein said probe means comprises a bead-like ball, and wherein said body of said core is formed with a bore extending axially into said body, and wherein said spring means comprises a spring in said bore, and said ball overlies said spring, walls bounding said bore being swaged at an open end of said bore to provide a constricted mouth having a diameter less than a diameter of said ball to restrain said ball in said bore, with a portion of said ball being urged resiliently outwardly thereof for seating in said depression in said locking plate.

5. The structure as set forth in claim 1 and further comprising channel means formed in said cap and defining an annular, moat-like depression therein, display means seated in and secured within said depression for carrying indicia to be displayed for product identification and for decorative purposes.

6. In a ratchet wrench including a drive head, a core having a body surmounted by a radially-enlarged cap, said core body being sleeved within and rotatable in and releasably secured in said drive head, a shank fastened to and projecting from said core body axially thereof for releasably securing a tool to said shank, pawl means intercoupling said drive head with said core body for reversibly driving said core body and said shank attached thereto in each of selective, opposed annular driving modes upon rotation of said drive head, and interlock means for securing said core in said drive head, the improvement wherein said interlock means comprises flange means carried by and extending radially outwardly of said shank and spaced axially from said core body, said flange means and said core body defining an annular channel therebetween, and arcuately shiftable locking plate means having a diametric boundary exceeding a diameter of said core, said locking plate means having a central, key-way-like opening of a non-circular configuration for receiving said flange means of said interlock means therethrough upon positioning of said plate means, said locking plate means overlying said drive head;

wing means integrally formed with and generally coplanar with said plate means, said wing means constituting a radially inwardly directed keying projection of said plate means extending into said central opening thereof for slidably and matingly invading said channel to seat therewithin upon arcuate rotation of said plate means through an annular sector and about said shank to establish an orientation of said wing means in at least partial vertical alignment with said flange means and preventing withdrawal of said core axially from said drive head, said plate means being rotatably shiftable to withdraw said wing means from said channel and to permit removal of said plate means from said shank and to allow axial displacement of said core with respect to and withdrawal of said core from said drive head.

* * * * *